US008141545B2

(12) United States Patent
Matsuura et al.

(10) Patent No.: US 8,141,545 B2
(45) Date of Patent: Mar. 27, 2012

(54) SYSTEM AND METHOD FOR CRANKCASE GAS AIR TO FUEL RATIO CORRECTION

(75) Inventors: Kenji D. Matsuura, Marysville, OH (US); James S. Robinson, Delaware, OH (US)

(73) Assignee: Honda Motor Co., Ltd., Tokyo (JP)

( * ) Notice: Subject to any disclaimer, the term of this patent is extended or adjusted under 35 U.S.C. 154(b) by 315 days.

(21) Appl. No.: 12/537,770

(22) Filed: Aug. 7, 2009

(65) Prior Publication Data

US 2010/0031904 A1 Feb. 11, 2010

Related U.S. Application Data

(60) Provisional application No. 61/087,403, filed on Aug. 8, 2008.

(51) Int. Cl.
*F02B 25/06* (2006.01)
*F02B 25/00* (2006.01)

(52) U.S. Cl. ..... 123/572; 123/704

(58) Field of Classification Search ..... 123/572, 123/573, 574, 520, 516, 521, 198 D, 704, 123/406.47; 701/103
See application file for complete search history.

(56) References Cited

U.S. PATENT DOCUMENTS

| | | | | |
|---|---|---|---|---|
| 4,606,321 | A * | 8/1986 | Gallegos del Bosque | 123/574 |
| 5,331,940 | A * | 7/1994 | Takayama | 123/679 |
| 5,911,213 | A | 6/1999 | Ahlborn et al. | |
| 6,098,603 | A * | 8/2000 | Maegawa et al. | 123/572 |
| 6,575,022 | B1 | 6/2003 | Schneider et al. | |
| 6,779,516 | B1 | 8/2004 | Shureb | |
| 6,892,715 | B2 | 5/2005 | Norrick | |
| 7,171,960 | B1 | 2/2007 | Hagari | |

* cited by examiner

*Primary Examiner* — Mahmoud Gimie
(74) *Attorney, Agent, or Firm* — Plumsea Law Group, LLC; Mark E. Duell

(57) ABSTRACT

A method and a system for correcting combustion in an engine to control for the effect of crankcase gases in the intake system are disclosed. The system includes one or more sensors in the crankcase ventilation system. An air to fuel ratio sensor may be disposed within a breather line and/or a PCV line of the crankcase ventilation system to monitor crankcase gases.

20 Claims, 3 Drawing Sheets

SYSTEM AND METHOD FOR CRANKCASE GAS AIR TO FUEL RATIO CORRECTION

CROSS-REFERENCE TO RELATED APPLICATION

This application claims priority under 35 U.S.C. §119(e) to U.S. Provisional Patent Application No. 61/087,403, entitled "System and Method for Crankcase Gas Air to Fuel Correction", and filed on Aug. 8, 2008, which application is hereby incorporated by reference.

BACKGROUND

The present invention relates to motor vehicles and in particular to a crankcase gas air to fuel ratio correction system.

Systems for monitoring crankcase or 'blow-by' gases have been previously proposed. Hagari (U.S. Pat. No. 7,171,960) teaches a control apparatus for an internal combustion engine. In one embodiment of the Hagari control apparatus, an injector is controlled in order to reduce the influence of blow-by gas on the air fuel ratio, thereby further improving the purification performance of the blow-by gas. Hagari teaches the use of an air fuel ratio sensor that is disposed within the exhaust line of the engine. Hagari further teaches the use of a blow-by gas passage and a blow-by gas valve that controls the amount of blow-by gas that may enter back into the intake line of the engine via the blow-by gas passage. Based on measurements made by the air fuel ratio sensor, and calculations performed using an electronic control unit, a correction to the amount of fuel injected using the injector is made so as to maintain a selected air to fuel ratio within the engine even when blow-by gas is present in the intake manifold. Hagari fails to teach the concept of directly measuring the air quality of crankcase gases.

Ahlborn et al. (U.S. Pat. No. 5,911,213) teaches a process for operating an electrostatic filter for a crankcase ventilator. Ahlborn teaches the use of an electrostatic filter that is used to separate oil from crankcase gases. The crankcase gases are supplied to the electrostatic filter, which filters out oil and possibly other contaminates, and produces a purified gas that is further fed to a sensor. The sensor determines the contamination level of the purified gas and then the purified gas is returned to the intake line of the engine. Based on the level of contamination, the voltage of the electrostatic filter can be modified to increase or decrease the amount of filtering performed by the electrostatic filter. Ahlborn further teaches collecting the filtered oil and returning it the crankcase or to a separate collection vessel.

Norrick (U.S. Pat. No. 6,892,715) also teaches a crankcase ventilation system. Norrick teaches a ventilation system for re-introducing blow-by gases in engine systems including turbochargers and after-coolers. In order to prevent contamination of a turbocharger and after-cooler from contaminating particles often found in blow-by gases, the blow-by gases in the Norrick design are routed through a breather port in the crankcase, and through a breather line, to a separate turbocharger or air-compressor. Following this, the compressed blow-by gas is reintroduced into the intake air stream downstream of the turbocharger and after-cooler. Norrick mentions the possibility of adding a sensor at the breather port that monitors the amount of blow-by gases.

Shureb (U.S. Pat. No. 6,779,516) teaches a closed crankcase ventilation system for re-circulating effluent gas stream of an internal combustion engine. Shureb teaches the use of an air-flow monitor inside the ventilation system in order to allow continuous monitoring of engine blow-by gas flow to evaluate the condition of an engine and to diagnose problems associated with increased blow-by gas flow. Shureb teaches the use of the air-flow monitor inside a ventilation system that runs from the crankcase to the engine air intake manifold. Shureb teaches the use of either a turbine air flow meter, or in some cases, a mass flow sensor. Using the mass flow sensor, the system could detect an increase in oil concentration to the effluent gas stream. Although Shureb teaches the use of an air-flow monitor inside a ventilation system for blow-by gases, Shureb does not teach a sensor used for determining air to fuel ratios of the blow-by gases.

Schneider et al. (U.S. Pat. No. 6,575,022) teaches an engine crankcase gas blow-by sensor. Schneider teaches a sensor that measures the pressure of the blow-by gas in order to determine the volume of blow-by gas in an effort to monitor the engine health. Schneider teaches a system where crankcase gases are caused to flow through a venturi that includes high pressure and low pressure taps. The high and low pressure taps are coupled to a differential pressure transducer that produces an output that is proportional to the volumetric flow of crankcase gases through the venturi. In the Schneider design, an inlet port of the venturi is coupled to the interior of the crankcase while the outlet port is coupled to the air intake system of the engine. Schneider does not teach or render obvious the use of other sensors that may be used to monitor the air to fuel ratio of the crankcase gases.

The prior art has additional shortcomings. There is no teaching in the prior art of a ventilation system with sensors used to monitor blow-by gases where the sensors are in communication with a fuel injector or an ignition timing system. There is a need in the art for a system and method that addresses the problems of the prior art.

SUMMARY

A method and a system for correcting combustion in an engine to control for the effect of crankcase gases in the intake system are disclosed. Generally, these methods can be used in connection with an engine of a motor vehicle. The invention can be used in connection with a motor vehicle. The term "motor vehicle" as used throughout the specification and claims refers to any moving vehicle that is capable of carrying one or more human occupants and is powered by any form of energy. The term motor vehicle includes, but is not limited to cars, trucks, vans, minivans, SUV's, motorcycles, scooters, boats, personal watercraft, and aircraft.

In some cases, the motor vehicle includes one or more engines. The term "engine" as used throughout the specification and claims refers to any device or machine that is capable of converting energy. In some cases, potential energy is converted to kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy, for example, some engines include regenerative braking systems where kinetic energy from a drivetrain is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

In one aspect, the invention provides an engine associated with a motor vehicle, comprising: a ventilation line having a first end in fluid communication with an interior of a crankcase and a second end in fluid communication with an intake manifold and where the ventilation line conveys crankcase gases from the interior of the crankcase to the interior of the intake manifold; a sensor configured to gather information related to crankcase gases; an electronic control unit in communication with the sensor and a fuel injector; the electronic control unit configured to calculate a fuel injection duration according to information related to the crankcase gases received from the sensor; and where the electronic control unit is configured to control the fuel injector according to the fuel injection duration.

In another aspect, the ventilation line is a positive crankcase ventilation line.

In another aspect, the engine includes a breather line configured to introduce fresh air from an intake line into the crankcase.

In another aspect, the sensor is an air to fuel ratio sensor.

In another aspect, the sensor is a wide band lambda air to fuel ratio sensor.

In another aspect, the sensor is configured to receive information related to contaminants in crankcase gases.

In another aspect, the invention provides a method for controlling combustion in an engine, comprising the steps of: receiving information from a plurality of sensors, including a sensor disposed within a ventilation line that is configured to connect a crankcase with an intake manifold; measuring properties of the crankcase gases using the sensor; determining a crankcase gas correction parameter according to information received from the sensor; and controlling a fuel injector according to a set of parameters, the set of parameters including the crankcase gas correction parameter.

In another aspect, the crankcase gas correction parameter is related to an air to fuel ratio of the crankcase gases.

In another aspect, the crankcase gas correction parameter is related to a contaminant concentration of the crankcase gases.

In another aspect, the set of parameters are used to calculate a fuel injection duration.

In another aspect, an ignition timing correction parameter is determined according to information received from the sensor.

In another aspect, the step of controlling the fuel injector is replaced by a step of controlling a spark plug according to the ignition timing correction parameter.

In another aspect, the step of controlling the fuel injector includes an additional step of controlling a spark plug according to the ignition timing correction parameter.

In another aspect, the contaminant concentration is an oil particle concentration.

In another aspect, the ventilation line is associated with a PCV valve configured to control the flow of crankcase gases through the ventilation line.

In another aspect, the invention provides a method of controlling a fuel injector associated with an engine, comprising the steps of: sensing information related to an air to fuel ratio of crankcase gases from a crankcase interior that are recirculated into an intake manifold; and controlling the fuel injector according to the information related to the air to fuel ratio of the crankcase gases.

In another aspect, the step of sensing information related to the air to fuel ratio of crankcase gases involves receiving information from a sensor.

In another aspect, the fuel injector is controlled to inject less fuel when the air to fuel ratio of the crankcase gases is high.

In another aspect, the ignition timing of the engine is controlled according to information related to the air to fuel ratio of the crankcase gases.

In another aspect, the fuel injector is controlled according to a plurality of parameters, including engine speed and engine load.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
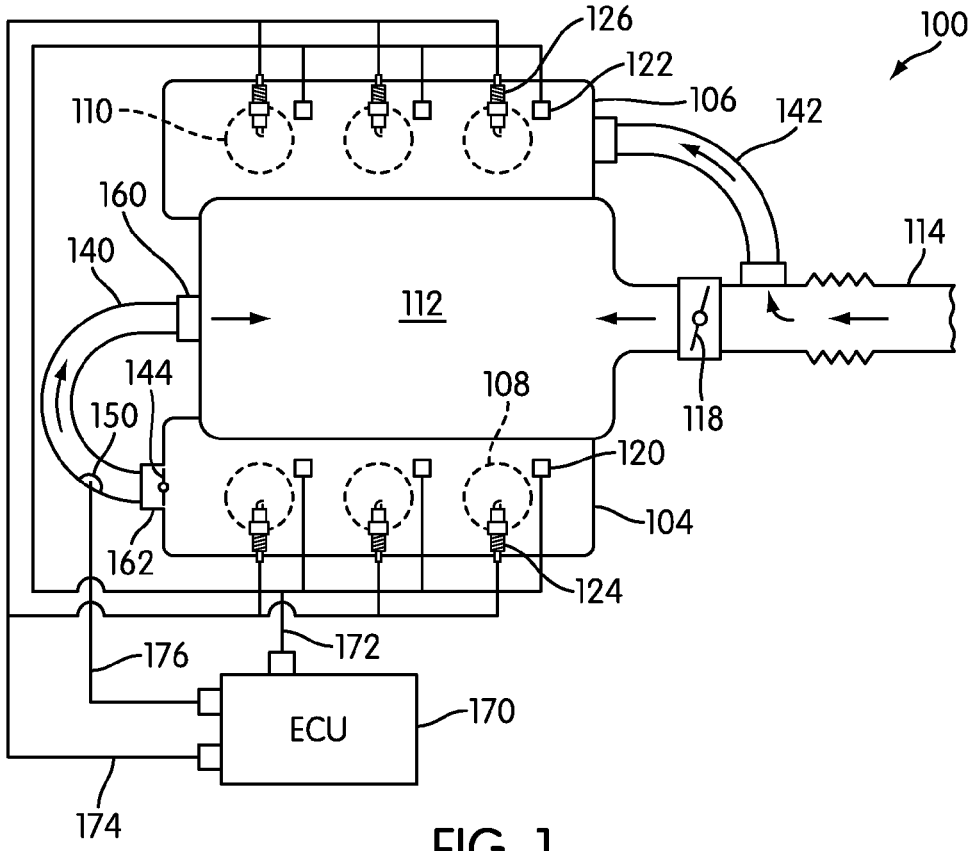
FIG. 1 is a schematic view of an embodiment of an engine.

FIG. 1 is a schematic view of an embodiment of engine 100. Engine 100 may be associated with a motor vehicle of some kind. For the purposes of clarity, engine 100 is illustrated as a V6 engine in the following embodiments, however it should be understood that in other embodiments, engine 100 could include any number of cylinders.

Engine 100 may include first cylinder bank 104 and second cylinder bank 106. First cylinder bank 104 may include first cylinder set 108 and second cylinder bank 106 may include second cylinder set 110. Generally, the number of cylinders comprising cylinder sets 108 and 110 may vary. In an embodiment, cylinder banks 108 and 110 each comprise three cylinders.

First cylinder set 108 and second cylinder set 110 may be associated with various provisions for facilitating combustion. In this embodiment, first cylinder set 108 and second cylinder set 110 may be associated with first fuel injector set 120 and second fuel injector set 122, respectively. Fuel injector sets 120 and 122 each comprise three fuel injectors in the current embodiment, where each injector is associated with a distinct cylinder. Furthermore, first cylinder set 108 and second cylinder set 110 may be associated with first spark plug set 124 and second spark plug set 126. Spark plug sets 124 and 126 each comprise three spark plugs in the current embodiment, where each spark plug is associated with a distinct cylinder.

Although they are not depicted in FIG. 1, each of the cylinders comprising cylinder sets 108 and 110 may be further associated with other provisions for facilitating combustion. These additional provisions may include, but are not limited to, pistons, cam shafts, intake valves, as well as other components that are necessary for the functioning of engine 100.

Engine 100 may include provisions for receiving air at cylinder banks 104 and 106. Air flowing through intake line 114 may be received into intake manifold 112 by way of throttle 118. In some embodiments, intake manifold 112 may be disposed between first cylinder bank 104 and second cylinder bank 106. In an embodiment, intake manifold 112 may be configured to distribute air to each of the cylinders comprising cylinder banks 104 and 106.

Figure 2:
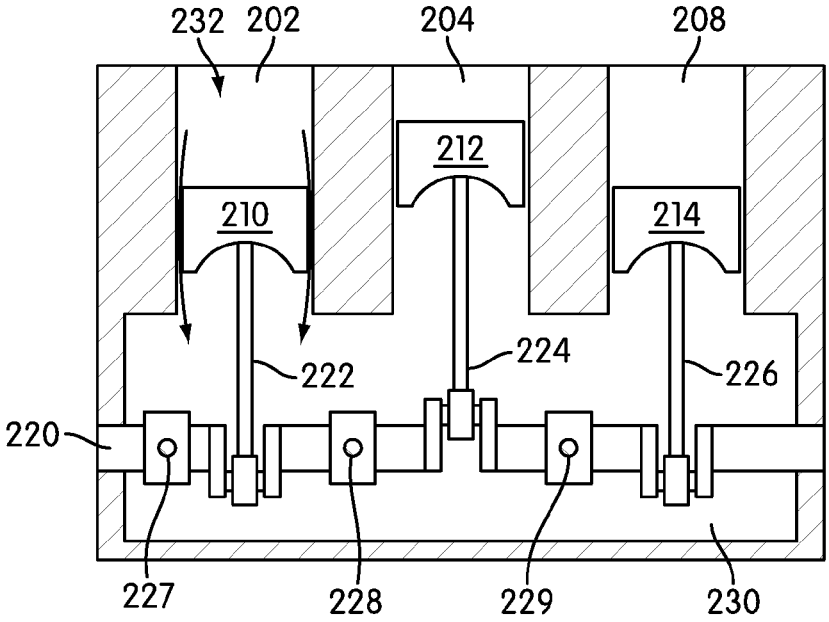
FIG. 2 is a cross sectional view of an embodiment of a portion of an engine including a crankcase.

FIG. 2 is a cross sectional view of an embodiment of a portion of second cylinder bank 106. As previously discussed, second cylinder bank 106 may include second cylinder set 110. Second cylinder set 110 may include first cylinder 202, second cylinder 204 and third cylinder 208. Cylinders 202, 204 and 208 are further associated with first piston 210, second piston 212 and third piston 214. As pistons 210, 212 and 214 move up and down within cylinders 202, 204 and 208 during combustion, they may apply torque to crankshaft 220 through first connecting rod 222, second connecting rod 224 and third connecting rod 226.

Although only pistons 210, 212 and 214 associated with second cylinder set 110 are shown in FIG. 2, pistons associated with first cylinder set 108 may also be connected to crankshaft 220 via fourth connecting rod 227, fifth connecting rod 228 and sixth connecting rod 229 (which are shown here in cross section only). The following discussion refers to second cylinder set 110 for purposes of clarity, however it should be understood that any discussion associated with cylinders 202, 204 and 208 could equally be applied to cylinders comprising first cylinder set 108.

Generally, crankshaft 220 is disposed within crankcase 230. Crankcase 230 may be separated from combustion occurring within cylinders 202, 204 and 208 by pistons 210, 212 and 214. Although pistons 210, 212 and 214 are configured to have a tight seal with cylinders 202, 204 and 208, during normal engine operation some unburned fuel and exhaust gases may escape past pistons 210, 212 and 214 and enter crankcase 230 below. In the current embodiment, for example, arrows indicate the flow of air from first combustion chamber 232 past first piston 210 to crankcase 230. Such 'leakage' of unburned fuel and exhaust gases are referred to as crankcase gases or 'blow-by' gases. In the current embodiment, the spacing between pistons 210, 212 and 214, and the walls of cylinders 202, 204 and 208, are exaggerated for illustrative purposes. Generally, this spacing is not visible. In some embodiments, for example, pistons 210, 212 and 214 include additional piston rings that facilitate a 'seal' between pistons 210, 212 and 214 and cylinders 202, 204 and 208 although leaking of gases still occurs.

Engine 100 includes provisions for venting crankcase gases collecting within crankcase 230. Often, ventilation may be achieved by re-circulating the crankcase gases into the intake system of the engine. This may direct ventilation of the crankcases gases into the atmosphere, since the crankcase gases may contain unwanted pollutants including unburned fuel. Typically, ventilation of crankcase gases to the intake system is achieved through the use of a positive crankcase ventilation system, including a positive crankcase ventilation line (hereby referred to as a PCV line) and a breather line. Generally, PCV lines are used to introduce crankcase gases to an intake manifold directly, while breather lines are used to introduce fresh air to the crankcase from a point upstream of a throttle within the intake line.

In the exemplary embodiment, engine 100 may be associated with PCV line 140. PCV line 140 transports crankcase gases from crankcase 230 to intake manifold 112. In the current embodiment seen in FIG. 1, first end 160 of PCV line 140 may be in fluid communication with intake manifold 112. Likewise, second end 162 of PCV line 140 may be in fluid communication with crankcase 230 that is disposed at the bottom of engine 100.

In the current embodiment, PCV line 140 is disposed near first cylinder bank 104, however it should be understood that crankcase 230 is associated with both cylinder banks 104 and 106. Flow through PCV line 140 may be regulated by PCV valve 144. PCV valve 144 generally acts to control the flow of crankcase gases from crankcase 230 to intake manifold 112. During low load conditions, PCV valve 144 may restrict flow through PCV line 140. During high load conditions, PCV valve 144 may allow increased flow through PCV line 140. Because the volume of crankcase (or blow-by) gases increases with engine load, PCV valve 144 may ensure that contaminants are flushed from crankcase 230 during high load conditions.

Engine 100 may also include breather line 142. Breather line 142 may facilitate the 'cleaning' of crankcase 230, by allowing fresh air from intake line 114 to flow through crankcase 230. This fresh air may pick up contaminants and water vapor. The air then leaves crankcase 230 via PCV line 140 when PCV valve 144 is open. Although breather line 142 is disposed near second cylinder bank 106, it should be understood that breather line 142 connects to crankcase 230 that is associated with both cylinder banks 104 and 106.

Because crankcase gases may include unknown levels of unburned fuel and other possible contaminants (such as oil that is collected within the crankcase), introduction of crankcase gases into the intake manifold may change combustion properties of the intake air as crankcase gases are mixed with fresh air. In some embodiments, engine 100 includes provisions for monitoring crankcase gases. In an embodiment, engine 100 includes sensors disposed within the PCV line or the breather line to gather information about crankcase gases. In some cases, this information may then be used to apply corrections to combustion within engine 100.

In some embodiments, engine 100 may include sensor 150 that is disposed within PCV line 140. Sensor 150 is configured to monitor crankcase gases flowing through PCV line 140. Sensor 150 may be any type of sensor configured to gather information related to fuel concentrations, oil particle concentrations, water vapor, as well as other contaminants that may comprise crankcase gases. Furthermore, sensor 150 may be configured to monitor quantities of airflow, air speeds or other physical characteristics of crankcase gases. In an embodiment, sensor 150 can provide air-fuel ratio information of the crankcase gases. Generally, because the air-fuel ratio of the crankcase gases is very low, a wide band lambda air to fuel ratio sensor can be used.

Although only a single sensor associated with PCV line 140 is shown in this embodiment, in other embodiments any number of sensors may be used. Furthermore, sensor 150 may be disposed anywhere along PCV line 140, including at first end 160 associated with intake manifold 112 or second end 162 associated with crankcase 230.

Engine 100 may include provisions for communicating (and in some cases controlling) the various components associated with engine 100. In the current embodiment, engine 100 may be associated with electronic control unit 170, hereby referred to as ECU 170. In some embodiments, ECU 170 may be a computer or similar device associated with a motor vehicle. ECU 170 may be configured to communicate with, and/or control, additional components of a motor vehicle not associated with engine 100.

In the current embodiment, ECU 170 may be configured to communicate with components of engine 100 associated with combustion. ECU 170 may communicate with first fuel injector set 120 and second fuel injector set 122 via first circuit 172. Likewise, ECU 170 may communicate with first spark plug set 124 and second spark plug set 126 via second circuit 174. Circuits 172 and 174 may comprise one or more connections. The connections could be electrical wires or wireless connections of some kind.

Generally, fuel injector sets 120 and 122 and ECU 170 may be referred to as a 'fuel injection system'. In this embodiment, any type of electronic fuel injection system known in the art may be used. Examples and details of such systems, as well as control methods for the systems, may be found in U.S. Pat. Nos. 4,418,674 to Hasegawa et al., 4,459,961 to Nishimura et al., and 4,862,369 Yakuwa et al., which are all assigned to Honda Motor Company, and the entirety of which are all incorporated herein by reference.

ECU 170 may be also be configured to communicate with sensor 150 using third circuit 176. In particular, ECU 170 may be configured to receive information gathered by sensor 150 using third circuit 176. Third circuit 176 may be an electrical wire or a wireless connection of some kind.

Generally, ECU 170 may be configured to communicate with additional components of engine 100 not shown in the Figures. ECU 170 may communicate with any number of components, including, for example, intake valves, exhaust valves, as well as other components used for controlling combustion known in the art. In other embodiments, multiple electronic control units may be used. In these other embodiments, each control unit may be associated with one or more components and in communication with one another.

ECU 170 may be configured to control the amount of fuel injected into each cylinder so that the efficiency of combustion is maximized. ECU 170 may monitor multiple parameters associated with engine 100 and determines the amount of fuel that should be injected. Because the amount of fuel injected into a cylinder is determined by the length of time each fuel injector is opened ECU 170 may determine a fuel injection duration according to the multiple engine parameters.

Figure 3:
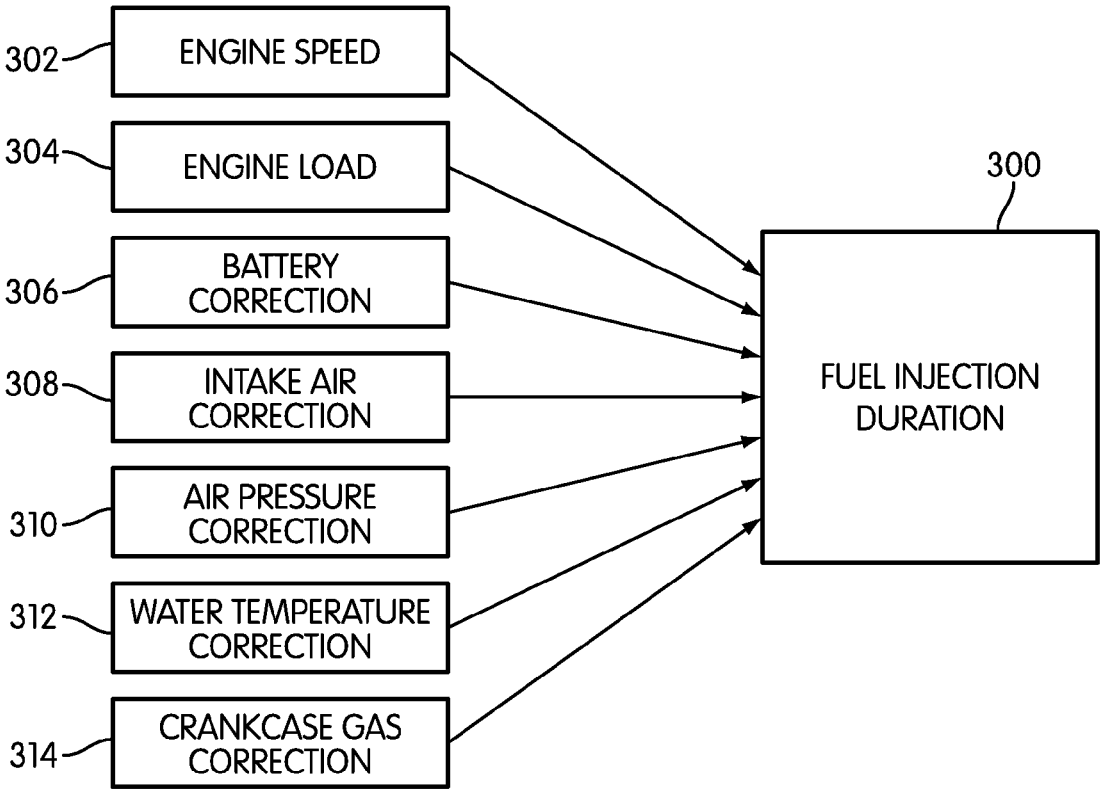
FIG. 3 is an embodiment of an operational relationship of various engine parameters and fuel injection duration.

FIG. 3 is an embodiment of an operational relationship of various engine parameters that may be used by ECU 170 to determine fuel injection duration 300. In the current embodiment, ECU 170 may make use of several parameters, including engine speed parameter 302, engine load parameter 304, battery correction parameter 306, intake air correction parameter 308, air pressure correction parameter 310, water temperature correction parameter 312 and crankcase gas correction parameter 314. It should be understood that the parameters discussed here are only intended to be exemplary. These parameters are optional and in other embodiments additional parameters may be included as well.

In the current embodiment, ECU 170 may determine a basic fuel injection duration according to engine speed parameter 302 and engine load parameter 304. In some embodiments, ECU 170 may receive engine speed parameter 302 from an engine speed sensor and ECU 170 may receive engine load parameter 304 from a manifold absolute pressure (MAP) sensor. This basic fuel injection duration may then be modified or 'corrected' using additional correction parameters.

In some embodiments, ECU 170 may adjust fuel injection duration 300 according to battery correction parameter 306. Generally, ECU 170 sends an electronic signal of a predetermined length of time to open a fuel injector for the length of the signal. In some cases, variations in the voltage of the signal applied to a fuel injector may cause variations in the actual time the fuel injector is open. Therefore, battery correction parameter 306 may be used to adjust the fuel injection duration according to the amount of voltage applied to a fuel injector.

Additionally, ECU 170 may adjust fuel injection duration 300 according to intake air correction parameter 308, air pressure correction parameter 310 and water temperature correction parameter 312. Intake air correction parameter 308 may be an intake air temperature correction parameter used to adjust the fuel injection duration due to changes in density of the intake air for different temperatures. Air pressure correction parameter 310 may be used to compensate for changes in ambient air pressure. In some embodiments, water temperature correction parameter 312 may be used to increase the fuel injection duration (thus increasing the air to fuel ratio in the combustion chamber) whenever the temperature of the coolant or another liquid associated with engine 100 is low. This is useful since a high air to fuel ratio is important when engine 100 is cold.

The current design includes provisions for correcting fuel injection duration 300 according to information about crankcase gases received by sensor 150. Using crankcase gas correction parameter 314, ECU 170 may adjust fuel injection duration 300 to account for the air to fuel ratio of the crankcase gases introduced into intake manifold 112. For example, if the crankcase gases have a high concentration of unburned fuel then fuel injection duration 300 may be decreased (which decreases the amount of fuel added).

In contrast to the current design, the previous designs failed to account for the air quality of crankcase gases that were introduced into intake manifold 112, among other distinctions. In such designs, whenever crankcase gases carry high concentrations of unburned fuel to the intake manifold, the resulting air to fuel ratio following fuel injection may be significantly higher than the intended air to fuel ratio based on various other engine parameters. This decreases the efficiency of combustion and could lead to performance problems in some cases.

Figure 4:
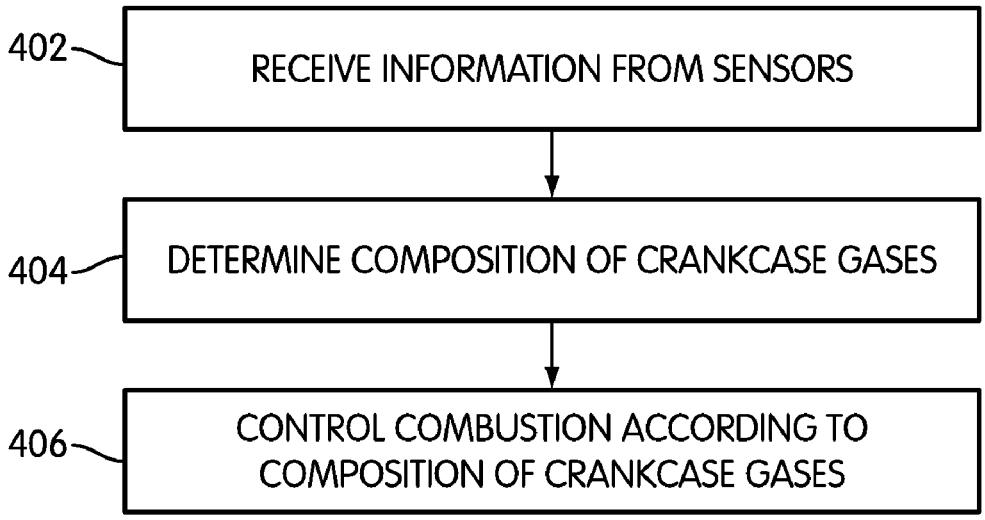
FIG. 4 is an embodiment of a process for controlling combustion in an engine according to various engine parameters.

FIG. 4 is an embodiment of a process for controlling combustion according to information related to various engine parameters. This process is generally related to the operational relationship discussed in FIG. 3. The following steps may be performed by ECU 170, however in some embodiments some of these steps may be performed by another control unit of some kind. During first step 402, ECU 170 may receive information from various sensors. During step 402, ECU 170 may receive information from sensors associated with the various parameters previously discussed, including engine speed, engine load, battery voltage, intake air properties, water temperature as well as crankcase gas properties. In one embodiment, ECU 170 may receive information from sensor 150 related to crankcase gases. During a second step 404, ECU 170 may determine various parameters that are used to compute a fuel injection duration, as previously discussed. ECU 170 may determine the composition, including the air to fuel ratio of the crankcase gases. During a third and final step 406, ECU 170 may control combustion according to the parameters that were determined during the previous step 404.

Figure 5:
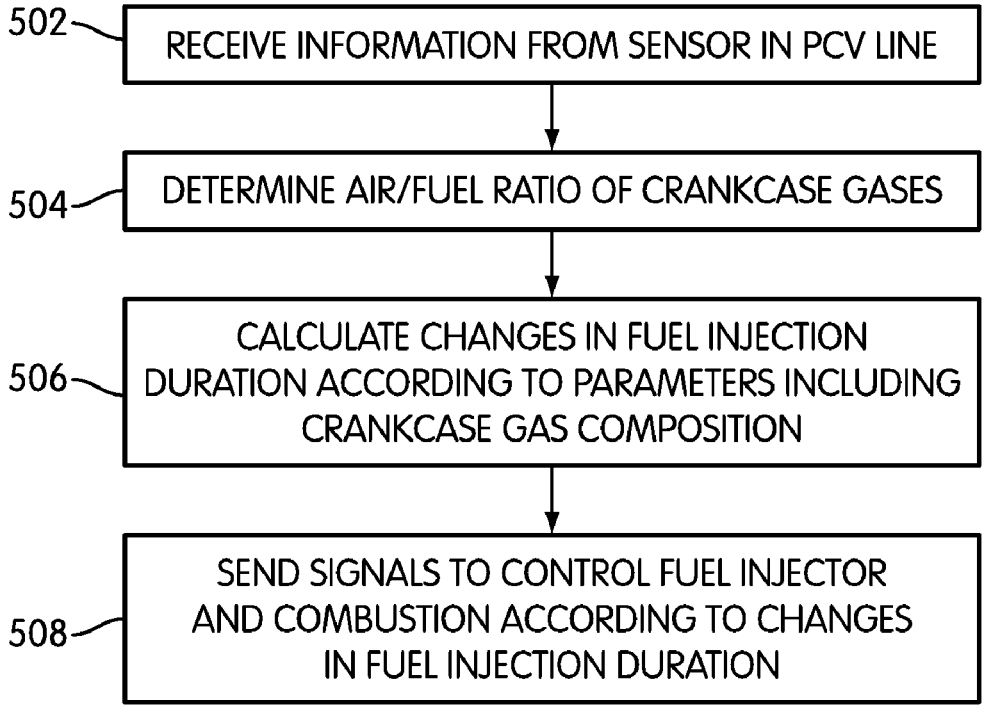
FIG. 5 is an embodiment of a process for controlling combustion in an engine according to crankcase gas properties.

FIG. 5 is an embodiment of a detailed process for controlling combustion according to information received from various engine parameters and in particular to the process for determining fuel injection duration according to the properties of crankcase gases. As with the previous process, the steps of this process may be performed by ECU 170. Furthermore, the following process is specific to controlling fuel injection durations according to crankcase gas correction parameter 314 and for clarity other engine parameters are not discussed. However, it should be understood that this process may be used in conjunction with similar processes associated with different engine parameters used to adjust fuel injection durations.

During a first step 502, ECU 170 may receive information from sensor 150 that is disposed within PCV line 140. As previously discussed, sensor 150 may be an air to fuel ratio sensor, such as a wide band lambda air to fuel ratio sensor. In other embodiments, sensor 150 may be used to determine contaminant properties as well, such as the concentration of oil particles in the crankcase gases. During a second step 504, ECU 170 may determine the air to fuel ratio of the crankcase gases according to information received from sensor 150. During third step 506, ECU 170 may calculate changes in fuel injection duration 300 according to various parameters including the crankcase gas air to fuel ratio. Finally, during a fourth and final step 508, ECU 170 may send one or more signals to fuel injector sets 120 and 122 to control fuel injection durations at each cylinder according to fuel injection duration 300 that has been corrected to account for the air to fuel ratio of the crankcase gases present in intake manifold 112. Likewise, in some embodiments, ECU 170 may send one or more signals to spark plug sets 124 and 126 to control ignition timing according to various properties of the crankcase gases, to achieve more efficient combustion. In still other embodiments, various other components of engine 100 may be controlled by ECU 170 according to modifications in combustion as determined by information related to crankcase gases as well as other engine parameters.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An engine associated with a motor vehicle, comprising:

a ventilation line having a first end in fluid communication with an interior of a crankcase and a second end in fluid communication with an intake manifold and wherein the ventilation line conveys crankcase gases from the interior of the crankcase to the interior of the intake manifold;

a sensor configured to gather information related to composition of the crankcase gases, including at least one of an air to fuel concentration, an oil particle concentration, and a water vapor concentration, wherein the sensor is disposed within the ventilation line;

an electronic control unit in communication with the sensor and a fuel injector;

the electronic control unit configured to calculate a fuel injection duration according to information related to the crankcase gases received from the sensor; and wherein the electronic control unit is configured to control the fuel injector according to the fuel injection duration.

2. The engine according to claim 1, wherein the ventilation line is a positive crankcase ventilation line.

3. The engine according to claim 2, wherein the engine includes a breather line configured to introduce fresh air from an intake line into the crankcase.

4. The engine according to claim 1, wherein the sensor is an air to fuel ratio sensor.

5. The engine according to claim 4, wherein the sensor is a wide band lambda air to fuel ratio sensor.

6. The engine according to claim 1, wherein the sensor is configured to receive information related to contaminants in crankcase gases.

7. A method for controlling combustion in an engine, comprising the steps of:

receiving information from a plurality of sensors, including a sensor disposed within a ventilation line that is configured to connect a crankcase with an intake manifold;

measuring properties associated with a composition of crankcase gases, including at least one of an air to fuel concentration, an oil particle concentration, and a water vapor concentration, using the sensor disposed within the ventilation line;

determining a crankcase gas correction parameter according to the information associated with the composition of the crankcase gases received from the sensor disposed within the ventilation line; and controlling a fuel injector according to a set of parameters, the set of parameters including the crankcase gas correction parameter.

8. The method according to claim 7, wherein the crankcase gas correction parameter is related to an air to fuel ratio of the crankcase gases.

9. The method according to claim 7, wherein the crankcase gas correction parameter is related to a contaminant concentration of the crankcase gases.

10. The method according to claim 7, wherein the set of parameters are used to calculate a fuel injection duration.

11. The method according to claim 7, wherein an ignition timing correction parameter is determined according to information received from the sensor.

12. The method according to claim 11, wherein the step of controlling the fuel injector is replaced by a step of controlling a spark plug according to the ignition timing correction parameter.

13. The method according to claim 11, wherein the step of controlling the fuel injector includes an additional step of controlling a spark plug according to the ignition timing correction parameter.

14. The method according to claim 9, wherein the contaminant concentration is an oil particle concentration.

15. The method according to claim 7, wherein the ventilation line is associated with a PCV valve configured to control the flow of crankcase gases through the ventilation line.

16. A method of controlling a fuel injector associated with an engine, comprising the steps of:

sensing information related to an air to fuel ratio of crankcase gases from a crankcase interior that are re-circulated into an intake manifold received from a sensor disposed within a ventilation line that is configured to connect the crankcase interior with the intake manifold; and controlling the fuel injector according to the information related to the air to fuel ratio of the crankcase gases.

17. The method according to claim 16, further comprising the step of sensing information related to the oil particle concentration of the crankcase gases received from the sensor disposed within the ventilation line.

18. The method according to claim 16, wherein the fuel injector is controlled to inject less fuel when the air to fuel ratio of the crankcase gases is high.

19. The method according to claim 16, wherein the ignition timing of the engine is controlled according to information related to the air to fuel ratio of the crankcase gases.

20. The method according to claim 16, wherein the fuel injector is controlled according to a plurality of parameters, including engine speed and engine load.

* * * * *